US007214296B2

(12) United States Patent
Meneghini

(10) Patent No.: US 7,214,296 B2
(45) Date of Patent: May 8, 2007

(54) ANODIC STRUCTURE FOR MERCURY CATHODE ELECTROLYTIC CELLS DESCRIPTION OF THE INVENTION

(75) Inventor: Giovanni Meneghini, Milan (IT)

(73) Assignee: De Nora Elettrodi, S.p.A. (IT)

( * ) Notice: Subject to any disclaimer, the term of this patent is extended or adjusted under 35 U.S.C. 154(b) by 564 days.

(21) Appl. No.: 10/467,259

(22) PCT Filed: Mar. 27, 2002

(86) PCT No.: PCT/EP02/03468

§ 371 (c)(1),
(2), (4) Date: Aug. 5, 2003

(87) PCT Pub. No.: WO02/077326

PCT Pub. Date: Oct. 3, 2002

(65) Prior Publication Data

US 2004/0074765 A1 Apr. 22, 2004

(30) Foreign Application Priority Data

Mar. 27, 2001 (IT) ..... MI01A0643

(51) Int. Cl.
*C25B 11/03* (2006.01)

(52) U.S. Cl. ..... 204/283; 204/284; 204/280; 204/292; 204/288; 204/289; 205/375; 205/378; 205/381; 205/620; 205/622; 205/623; 29/746

(58) Field of Classification Search ..... 204/283, 204/284, 292, 243.1, 247.3, 278.5, 288, 289; 205/375, 378, 381, 620, 622, 623; 29/746
See application file for complete search history.

(56) References Cited

U.S. PATENT DOCUMENTS 4,022,679 A * 5/1977 Koziol et al. ..... 204/284
4,263,107 A * 4/1981 Pellegri ..... 205/527

* cited by examiner

*Primary Examiner*—Bruce F. Bell
(74) *Attorney, Agent, or Firm*—Charles A. Muserlian

(57) ABSTRACT

Object of the invention is an anodic structure for mercury cathode cells for the industrial electrolysis of sodium chloride. The new structure is constituted by a grid array comprising a multiplicity of vertically disposed and mutually parallel titanium blades, covered by an electrocatalytic coating specific for the discharge of chlorine. The ratio between the thickness and the height of the blades is comprised between 1:16 and 1:100 and the ratio between the surface of free passage between the blades and the projected surface is comprised between 15:17 and 25:30. The new grid array is perpendicularly fixed to new or existing frames having the function of mechanical support and current conduction to the grid array. Scope of the invention is simultaneously reducing the energetic consumption of the cell and the costs for restoring the exhausted electrocatalytic coating.

12 Claims, 2 Drawing Sheets

ANODIC STRUCTURE FOR MERCURY CATHODE ELECTROLYTIC CELLS DESCRIPTION OF THE INVENTION

This application is a 371 of PGT/EP02/03468 filed Mar. 27, 2002.

The present invention is directed to a new type of metallic structure (hereafter called grid array) for gas evolving electrochemical reactions, and in particular for the anodic reaction of chlorine evolution in a mercury cathode cell for the electrolysis of sodium chloride with production of chlorine and sodium hydroxide. The scope of the invention is on one hand the reduction of the energetic consumption of the electrolysis cell, and on the other hand the reduction of the cost for restoring the electrocatalytic coating for chlorine evolution when the latter results deactivated.

BACKGROUND OF THE INVENTION

The production of chlorine and sodium hydroxide (chlor-alkali), about 45 millions of tons of chlorine per year, is carried out in electrolytic cells of different kinds, among which the mercury cathode electrolytic cell is of particular relevance, accounting for a production of about 12 millions of tons of chlorine per year.

In FIG. 1 a typical structure of a cell of this kind is outlined, consisting in an iron case (1) on whose bottom (2) the mercury amalgam (3) constituting the cathode flows. The anode is made by a multiplicity of electrodes shaped as a grid array (4), supported by mobile frames (5), preferably controlled by microprocessors having the purpose of regulating the interpolar gap, which may vary during the cell operation.

As 12 millions of ton chlorine/year are produced in cells at the following average operative conditions:

| | |
|---|---|
| Current density: | 10 kA/m$^2$ |
| Anode/cathode voltage: | 4.05 V |
| Faradaic yield: | 96% |
| Energy consumption: | 3185 kWh/ton $Cl_2$ |

this kind of technology involves a consumption of about 38 millions of MWh/year.

In consideration of the high amount of involved energy and of the continuous increase in the cost of electricity, the cell technology has been remarkably enhanced in the course of the years, with the aim of reducing the energetic consumption, representing the most relevant item in the production costs.

Among the numerous technological innovations which contributed the most to decrease the energetic consumption, the replacement of the graphite consumable anodes with the metallic anodes has to be emphasised: the latter are typically made of titanium or other valve metal, coated with electrocatalytic material generally based on noble metals and/or oxides thereof. This type of anode, an example of which is given in U.S. Pat. No. 3,711,385, is still commercialised under the trade-mark DSA® by De Nora Elettrodi S.p.A, Italy.

It consists in a metallic structure comprising one frame and one grid array, overlapped and mutually welded or somehow fixed; the frame performs the function of mechanical support and of element of direct electric current distribution to the surface of the grid array, which is coated with an electrocatalytic film specific for the chlorine evolution reaction, and constitutes the anodic active surface.

The geometry of the grid array plays a role of great importance on the efficiency of the electrolysis process and on the energetic consumption of a cell as it influences, in a determining way, both the voltage and the faradaic yield thereof. In fact, the anode/cathode voltage of a cell, expressed as Volts, can be calculated by means of the relationship:

$$V\ \text{anode/cathode} = 3.15 + K_f \times J$$

wherein J is the current density impressed to carry out the electrolytic process, expressed as kA/m$^2$, and the $K_f$ term (o "Key factor") incorporates all the components of resistive origin. The most important factors of such resistive components, namely the ohmic drop within the anodic structure, the ohmic drop in the electrolyte due to the bubble effect, and the ohmic drop in the electrolyte due to the interpolar gap, all depend from the anodic geometry; it is one of the main objects of the invention, in particular, to minimise the two latter factors.

The bubble effect is a measure of the increase of ohmic resistance in the electrolyte due to the gas bubbles developing on the anodic surface of the grid array and interrupting the electric continuity within the electrolyte itself. In particular, the bubble effect mainly depends on the number and size of the gas bubbles that are generated upon the anodic surface of the grid array and stagnate on the immediate vicinity thereof between the anode and the cathode; it further depends on the bubble ascending velocity, and on the descending velocity of the degassed electrolyte.

In summary, the bubble effect depends from the actual current density on the anodic surface (which determines the amount of bubbles developing per unit time), from the grid array geometry (which determines the ratio between actual working surface whereupon the gas is evolved and projected surface, as well as the gas withdrawal resistance), and from the optional added devices directed to improve the fluid dynamics. In particular, it is a first object of the present invention to provide an anodic grid array geometry producing a bubble effect minimisation.

Even in the absence of bubble effect, the ohmic drop within the electrolyte is directly proportional to the interpolar gap, so that it is extremely important to bring the anodic surface as close as possible to the mercury cathode, adjusting the gap between anode and cathode surfaces in a progressive fashion. It is however necessary to maintain a certain margin of safety, to avoid the mercury touching in some points the anodic surface, causing hazardous short-circuiting phenomena. For this reason, it will be possible to maintain as lower the interpolar gap as better is the planarity of the anodic structure. It is a further object of the present invention to provide an anodic grid array geometry with enhanced planarity characteristics with respect to the prior art.

In the most recent industrial cells, operating in ideal conditions, the $K_f$ is normally comprised between 0.065 and 0.085 V m$^2$/kA, depending on the cell size, the type of anode and the system of interpolar gap adjustment the cell is equipped with, whereof:

- ~0.0070–0.0080 V m$^2$/kA are attributable to the ohmic drop within the anodic structure.
- ~0.0310–0.0410 V m$^2$/kA are attributable to the bubble effect in correspondence of the anodic surface.
- ~0.0270–0.0360 V m$^2$/kA are attributable to the ohmic drop in the electrolyte, as a function of the interpolar gap.

In other words, about 10% of $K_f$ is attributable to the anode structure, about 50% to the bubble effect, and the remaining 40% to the interpolar gap.

For a given cell and at given process conditions, the minimum obtainable $K_f$ is therefore a property of the anode, to a large extent attributable to the grid array characteristics (in the order of about 90%), as it depends from the width of the region affected by the bubble effect and from the planarity of the grid array itself.

For this reason, since the introduction of the metallic anodes, the grid array has been the object of several inventions, among which are recalled for their industrial relevance:

The cited metallic anode of U.S. Pat. No. 3,711,385, which in the earliest industrial embodiments comprised a grid array made of meshes, or more commonly of a multiplicity of titanium rods of about 3 mm diameter and 4.5 mm pitch, disposed in parallel, and supported by a current distributing frame, in its turn made of rectangular titanium conductors. Although enjoying a remarkable success at the time of its introduction, this configuration presented some big limitations, due both to the bubble effect and to the shielding effect of the rods on the cathode surface, with consequent difficulties of electrolyte circulation and of gas withdrawal when operating at high current density and reduced interpolar gap. The best known industrial results with this type of anode, commonly called "Rod type anode", operating at 10 kA/m$^2$, are the following:

| | |
|---|---|
| Anode/cathode voltage: | 4.00 V |
| $K_f$: | 0.085 V m$^2$/kA |
| Faradaic yield: | ~96% |
| Energy consumption: | 3146 kWh/ton $Cl_2$ |

With the purpose of overcoming these drawbacks, U.S. Pat. No. 4,263,107 discloses hydrodynamic baffles, mounted on the upper part of the grid array, which generate convective motions so as to reduce the bubble effect, improve the fluid dynamics and ensure an effective renewal of the electrolyte.

The shielding effect of the rods has been subsequently reduced with the introduction of the invention disclosed in U.S. Pat. No. 4,364,811 according to which a grid array made of a multiplicity of rectangular strips, about 1.5 mm thick, 5 mm high and 4.0 mm spaced, defined as blades, arranged vertically respect to the cathode, was coupled to a frame of the prior art. The best known industrial results with this type of anode, operating at 10 kA/m$^2$, are the following:

| | |
|---|---|
| Anode/cathode voltage: | 3.90 V |
| $K_f$: | 0.075 V m$^2$/kA |
| Faradaic yield: | ~96% |
| Energy consumption: | 3067 kWh/ton $Cl_2$ |

Even better results were obtained by coupling the hydrodynamic means of U.S. Pat. No. 4,263,107 to a grid array made of triangular strips, with their vertex facing the mercury cathode, as disclosed in the Italian Patent n°1.194.397. This new configuration, in which said triangular strips have, as typical dimensions, 2.2 mm base, 3.7 mm height, rounded vertex of 0.5 mm diameter and pitch (intended as distance between the axis of two consecutive strips) 3.5 mm, has brought to an important reduction of the bubble effect and of the shielding effect of the rods, and to a sensible improvement of the fluid dynamics.

The best industrial results obtained with this type of anode, still commercialised by De Nora Elettrodi S.p.A under the trade-mark RUNNER®, operating at 10 kA/m$^2$, are the following:

| | |
|---|---|
| Anode/cathode voltage: | 3.80 V |
| $K_f$: | 0.065 m$^2$/kA |
| Faradaic yield: | ~96% |
| Energy consumption: | 2988 kWh/ton $Cl_2$ |

An alternative solution was proposed in U.S. Pat. No. 5,589,044, which discloses a frame similar to the previous ones, coupled to a grid array made of a multiplicity of rectangular strips and specially configured with the purpose of increasing the actual surface in correspondence of the vertical sides, and of decreasing the bubble stagnation effect on the surface facing the cathode. Although the results obtained with this kind of grid array are better than those obtained with the grid array of U.S. Pat. No. 4,364,811, they still remain inferior to those obtained with the grid array of IT 1.194.397.

The above described grid array configurations of the prior art, different in terms of hydrodynamic properties, bubble effect and shielding effect on the cathode, have however two different aspects in common:

- the overall anodic surface planarity is hampered by the fact that the tolerances relative to the multiplicity of elements constituting the grid array (rods, blades or strips) and to the welds needed to fix the latter to the frame add up to the tolerances related to the frame itself. For all the grid arrays of the prior art, the typical tolerances along the anodic surface range between 0.5 and 1 mm, although recurring to rather controlled and sophisticated (and thus costly) machining.
- the restoration of the catalytic properties of exhausted electrodic structures (to be repeated with cycles ranging from 2 to 5 years, depending on the operative conditions of the plant) involves complex and very expensive working consisting in the removal of the exhausted coating with mechanical (sandblasting) and chemical (etching) means frequently producing mechanical distortions; in some cases therefore, additional working is needed for restoring the planarity of the grid array, before (or after) providing a novel catalytic coating. The performances of a reactivated anode are virtually never quivalent to those of an anode of new construction, both because the planarity reinstatement is never perfect, and because the removal of the exhausted coating cannot be sometimes completed, or because the material constituting the grid array itself undergoes morphological changes that are not totally reversible. Finally, it is mandatory to remove the whole electrocatalytic coating even if just part of it has been consumed, in order to recover the full operability of the active surface. This involves a remarkable and useless consumption of matter consisting in extremely expensive precious metals such as ruthenium, iridium, platinum, and so on.

SUMMARY OF THE INVENTION

It is an object of the invention to provide a new grid array configuration which makes possible to overcome the problems of the prior art arising from the bubble effect, the fluid dynamics, the planarity of the anodic surface, the drawbacks associated to the reactivation of the exhausted elements.

BRIEF DESCRIPTION OF THE DRAWINGS

The invention will be described making reference to FIG. 2, which represents an axonometric view of an anodic grid array.

DETAILED DESCRIPTION OF THE INVENTION

Figure 1:
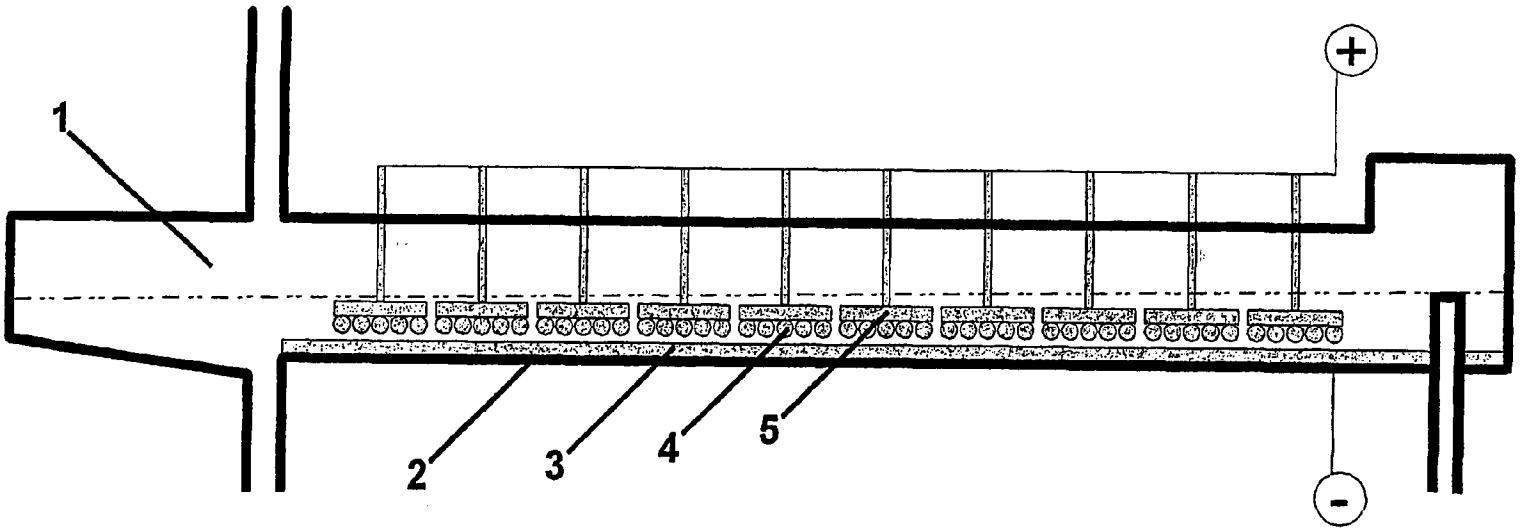
FIG. 1 is a cross-section of a mercury cathode electrolytic cell.
Figure 2:
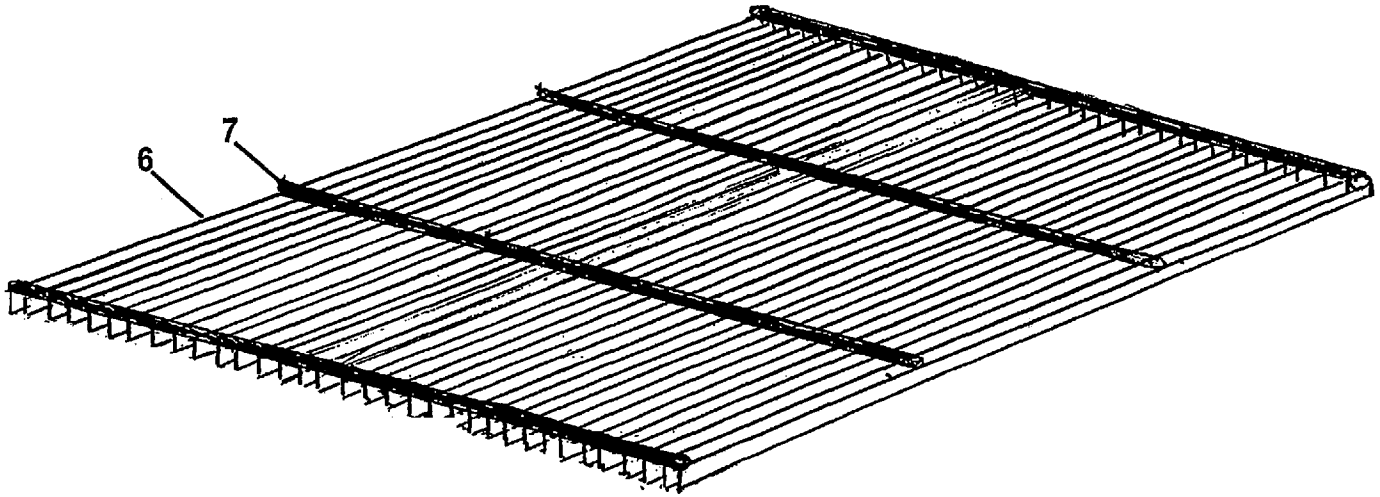
FIG. 2 is a view of an anodic grid array.

The latter comprises a multiplicity of blades (6) of a valve metal, for instance pure or alloyed titanium, generally parallel to each other, orthogonally fixed to a multiplicity of supporting elements, for instance rods (7), preferably made of the same valve metal as the blades (6); on the latter an electrocatalytic coating specific for the chlorine evolution reaction is preferably applied. In a preferred embodiment, the electrocatalytic coating is applied at least on the vertical walls of said blades, or at least on a portion thereof. The electrocatalytic coating is applied only on part of the grid array surface or on the whole surface thereof as known in the art.

The grid array of the invention must be fixed on a frame either new or used, having the function of mechanical support and of current conduction/distribution to the grid array itself. The size of the new grid array may vary according to the dimensions of the frame to which it has to be fixed and of the size of the cell in which it has to be installed. As a mere example, a type of frame according to the prior art foresees the use of grid array surfaces of about 700 mm×800 mm. The thickness of the blades (6) is comprised between 0.2 and 1 mm, and a particularly preferred value is 0.3–0.5 mm. The height of the blades is comprised between 8 and 20 mm, preferably 12 mm. The gap between two adjacent blades is comprised between 1.5 and 2.5 mm, and preferably 2.0 mm. In one preferred embodiment, for a grid array with a 700 mm×800 mm surface, the blades (6) are bonded by means of 4 titanium rods of 2–3 mm diameter orthogonally welded to the upper part thereof, acting as the supporting elements (7). The number, the dimensions and the nature of the supporting elements (7) may however vary depending on the grid array dimensions, the type of current-distributing frame and other considerations associated to the process parameters.

The disclosed configuration proved to be surprisingly effective in terms of bubble effect minimisation and fluid dynamics enhancement. Moreover, the particular geometry of the blades has a positive effect on the electrode planarity, simultaneously eliminating the need to proceed with costly and harmful reactivations. In fact:

The particular type of grid array, with long and spaced apart blades catalytically activated on the vertical walls, allows the grinding of its surface after the assemblage and activation. In other words, instead of adding the tolerances of the frame, of the elements constituting the grid array and of the relevant welds to determine the total tolerance, it is now possible to assemble the pre-activated grid array to the frame and proceed with an overall grinding (or other equivalent mechanical machining) of the surface that has to face the cathode, with overall tolerances not exceeding 0.2 mm (±0.1 mm). This allows maintaining extremely reduced interpolar gaps without the risk of hazardous and detrimental local short-circuiting phenomena. The described operation entails the abrasion of the blade material with elimination of the catalytic coating on the surface facing the mercury cathode (corresponding to the thickness of the blades). This elimination does not constitute a problem, since the effective catalytic coating is practically just the one deposited on the vertical walls of the blades.

The length of the blades gives rise to the fact that only part of the activated vertical surface constitutes the active working surface, and thus only part of the catalytic coating is subjected to consumption; once said part of the coating, corresponding to a few millimeters of blade, results exhausted, instead of subjecting the anode to reactivation, with all the above described associated drawbacks, it is sufficient to proceed with a new grinding that removes the exhausted portion. This procedure allows sensible savings in electrocatalytic coating and a significant reduction of manufacturing time, considering in particular that it may be repeated more than once, resulting in a consistent increase of the anode overall lifetime, in extremely reduced manufacturing costs, and in anode/cathode cell voltages almost unvaried along the whole anode lifecycle.

At a current density of 10 kA/$^2$m, a grid array of 700 mm×800 mm having the above disclosed preferred dimensions (blades 12 mm high, 0.3 mm thick, 2.0 mm spaced apart), coupled to the hydrodynamic means for the generation of convective motions disclosed in U.S. Pat. No. 4,263,107, gave the following results:

| | |
|---|---|
| Anode/cathode voltage: | 3.60 V |
| $K_f$: | 0.045 $m^2$/kA |
| Faradaic yield: | ~96% |
| Energy consumption: | 2832 kWh/ton $Cl_2$ |

with a overall energy saving of about 150 kWh/ton $Cl_2$ compared to the best performances of the RUNNER® electrode and of about 250 kwh/ton $Cl_2$ compared to the blade anodes of the prior art (according to the disclosure of U.S. Pat. No. 4,364,811). Without wishing the invention to be bound to any particular theory, the following reasons may be hypothesised for these utterly surprising performances:

A lower blade surface faces the mercury: 0.3 mm, according to the example of the invention, versus 1.5 and 0.5 mm respectively of the grid array of U.S. Pat. No. 4,364,811 and of the RUNNER® electrode in their known industrial embodiments; this factor allows the downright lessening of bubble stagnation in the portion of anodic surface facing the cathode, thereby improving the faradaic yield at the minimum interpolar gap.

A lower ohmic drop in the electrolyte is experienced as a lower interpolar gap may be maintained, due to the better planarity of the grid array surface, delimited by the longitudinal parts of the blades, which faces the cathode, having a maximum tolerance of 0.2 mm versus 0.5–1 mm obtainable, in the best cases, with the grid arrays of the prior art.

A greater actual anodic surface is provided on one hand to by the increased number of blades for unit projected surface (2.3 mm grid pitch according to the disclosed example, against 3.5–4.0 mm of the prior art), on the other hand by the decreased bubble stagnation effect, which affects this factor as well.

Improved fluid dynamics due to the height of the blades: 12 mm according to the example, versus 5.0 and 3.7 mm typical respectively of the grid arrays of U.S. Pat. No. 4,364,811 and IT 1.194.397 (RUNNER®). The increase in height gives rise to an efficient "chimney effect" with quick renewal of the electrolyte upon the electrode surface, and to a further reduction of the bubble effect due to a higher bubble ascending velocity.

The invention claimed is:

1. An anode for chlorine evolution in a mercury cathode chlor-alkali electrolytic cell comprising a current-distributing frame and a grid array of titanium or titanium alloy or other valve metal or valve metal alloy comprising a multiplicity of generally parallel blades fixed to a multiplicity of supporting elements, the blades having a thickness between 0.2 and 1.0 millimeters and a height of 8 to 20 millimeters, the distance between one blade and the next being between 1.5 and to 2.5 millimeters wherein at least the main vertical surfaces of the blades are provided with an electrocatalytic coating for chloride evolution and wherein the surfaces facing the mercury cathode of the terminal longitudinal parts of the blades are mechanically machined to define a plane having a tolerance not higher than 0.2 millimeters.

2. The anode of claim 1 wherein the upper surface of the grid array comprises hydrodynamic means for the generation of convective motions.

3. The anode of claim 1 wherein the supporting elements are made by rods.

4. The anode of claim 1 wherein the blades have a height of 12 millimeters, and the supporting elements are rods with a diameter between 2 and 3 millimeters orthogonally fixed to the upper surface of said blades.

5. The anode of claim 1 wherein the multiplicity of blades is fixed to the multiplicity of supporting elements by welding.

6. In an electrocatalytic mercury cathode cell for production of chlorine by electrolysis of aqueous sodium chloride solution, the improvement comprising the anode as that of claim 1.

7. An anode for chlorine evolution in a mercury cathode chlor-alkali electrolytic cell comprising a current-distributing frame and a grid array of titanium or titanium alloy or other valve metal or valve metal alloy comprising a multiplicity of generally parallel blades fixed to a multiplicity of supporting elements, the blades having a thickness between 0.2 and 1 millimeters and a height between 8 and 20 millimeters, the distance between one blade and the next being between 1.5 and 2.5 millimeters, wherein the terminal longitudinal parts of the blades are mechanically machined to define a plane having a tolerance not higher than 0.2 millimeters.

8. The anode of claim 7 wherein the blades have a thickness comprised between 0.3 and 0.5 millimeters.

9. A method for the production of an anode of claim 8 comprising activating the blades with an electrocatalytic coating, assembling the grid array to the frame, and providing a final mechanical machining of the surface of said grid array to be faced to the mercury cathode suited to ensure the planarity of said surface.

10. The method of claim 9 wherein said mechanical machining is a grinding.

11. A method for reactivation of an anode of claim 8, comprising mechanically removing a portion of said blades in correspondence of which said electrocatalytic coating is exhausted.

12. The method of claim 11 wherein said mechanical removal is carried out by grinding.

* * * * *